US006380822B1

(12) United States Patent
Lindgren

(10) Patent No.: US 6,380,822 B1
(45) Date of Patent: Apr. 30, 2002

(54) WAVEGUIDE SWITCH FOR ROUTING M-INPUTS TO M OF N-OUTPUTS

(75) Inventor: Gary M. Lindgren, Oak Park, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/500,758

(22) Filed: Feb. 8, 2000

(51) Int. Cl.[7] ..... H01P 1/06
(52) U.S. Cl. ..... 333/106; 333/256
(58) Field of Search ..... 333/106, 128, 333/256, 259, 261

(56) References Cited

U.S. PATENT DOCUMENTS 2,841,770 A * 7/1958 Hollis ..... 333/106
3,419,827 A * 12/1968 Webb ..... 333/106
4,201,963 A * 5/1980 Welti ..... 333/106
4,625,188 A * 11/1986 Bourgie ..... 333/257
4,806,887 A * 2/1989 Au-Yeung ..... 333/106
5,075,649 A * 12/1991 Pellegrineschi ..... 333/137
5,206,610 A * 4/1993 Nelson ..... 333/106
5,838,218 A * 11/1998 Rupert et al. ..... 335/4

* cited by examiner

*Primary Examiner*—Robert Pascal
*Assistant Examiner*—Dean Takaoka
(74) *Attorney, Agent, or Firm*—Terje Gudmestad

(57) ABSTRACT

A satellite signal routing system includes a satellite using one or more waveguide switches for routing M-inputs to M of N-outputs. A waveguide switch includes a first waveguide, used as a stationary input coupled to a rotary joint. A joint rotation device, such as a motor, rotates the rotary joint. A rotary waveguide is attached to the rotary joint and also rotates. Two or more second waveguides, used as stationary outputs, are coupled to the rotary waveguide through a non-contacting waveguide. A controller controls the joint rotation device to rotate the rotary joint to align the rotary waveguide with one of the second waveguides.

20 Claims, 1 Drawing Sheet

WAVEGUIDE SWITCH FOR ROUTING M-INPUTS TO M OF N-OUTPUTS

TECHNICAL FIELD

The present invention relates generally to microwave devices, and more particularly, to a non-blocking, low loss waveguide switch for routing M-inputs to M of N-outputs.

BACKGROUND ART

Typical communication satellites use R-switches to route microwave signals. In fact, in most satellites, numerous R-switches are employed in a Butler matrix implementation to allow the routing of M-inputs to M of N-outputs. Unfortunately, each switch adds insertion loss and the matrix implementation has restrictions on port selection due to blocking. The size of the R-switch is important because as more switches are used weight and volume increases can result in large cost penalties. Also, the size of the R-switch can impose restraints on a transponder layout. A reduction in size and volume of R-switches can provide extra flexibility in the layout process while reducing the weight of the spacecraft payload.

Usually, an R-switch has three waveguide paths, a straight central path and two curved E-bend waveguide paths. In a variation of existing R-switches, the two outer paths have waveguide corners instead of curved E-bends. Generally, the waveguide corner R-switch has worse isolation and return loss performance compared to the E-bend R-switch. Also, the straight waveguide in the center path limits the amount of size reduction that can be achieved. R-switches are generally used in association with an actuator that moves the R-switch to various predetermined positions. Since there are numerous R-switches used in most communication satellites, any mass or volume saving can result in a substantial overall saving.

Thus, there exists the need to route M-inputs to M of N-outputs using fewer, smaller switches. Ultimately, the desire is to route M-inputs to M of N-outputs using as little weight and space as possible while maintaining system reliability and low insertion loss without blocking.

SUMMARY OF THE INVENTION

It is, therefore, an object of the invention to provide an improved and reliable non-blocking, low loss waveguide switch for routing M-inputs to M of N-outputs. Another object of the invention is to reduce insertion loss while eliminating blocking.

In one aspect of the invention, a satellite signal routing system includes a satellite using one or more waveguide switches for routing M-inputs to M of N-outputs. A waveguide switch includes a first waveguide, used as a stationary input coupled to a rotary joint. A joint rotation device, such as a motor, rotates the rotary joint. A rotary waveguide is attached to the rotary joint and also rotates. Two or more second waveguides, used as stationary outputs, are coupled to the rotary waveguide through a non-contacting waveguide. A controller controls the joint rotation device to rotate the rotary joint to align the rotary waveguide with one of the second waveguides.

The present invention thus achieves an improved non-blocking, low loss waveguide switch for routing M-inputs to M of N-outputs. The present invention is advantageous in that it improves system reliability by reducing the number of switches required. The present invention also eliminates restriction on port selection due to blocking.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
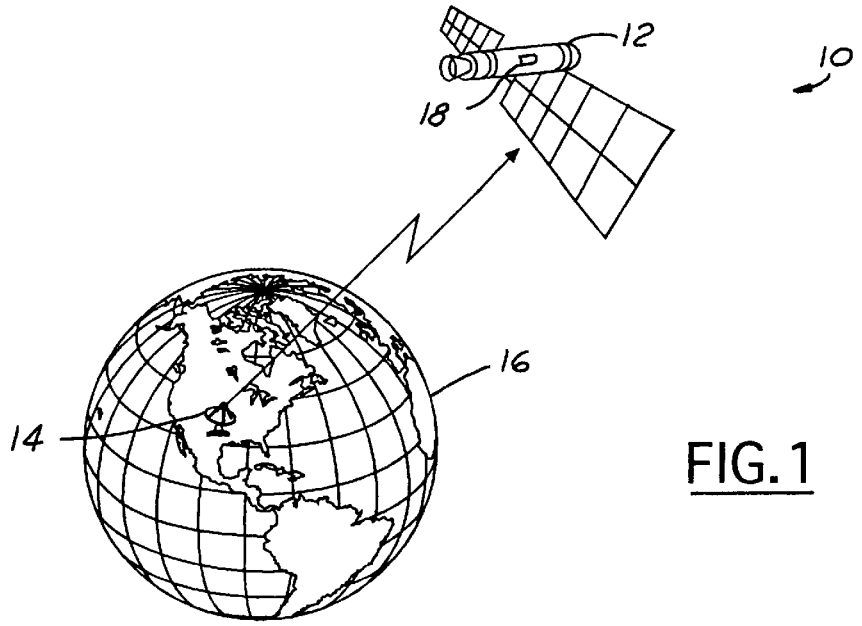
FIG. 1 is a perspective view of a satellite signal routing system in accordance with one aspect of the present invention.

Referring to FIG. 1, a perspective view of a satellite signal routing system 10 in accordance with one aspect of the present invention is illustrated. The satellite signal routing system 10 is comprised of one or more satellites 12 in communication with a ground station 14 located on Earth 16. Each satellite 12 contains one or more waveguide switches 18 for routing M-inputs to M of N-outputs.

Figure 2:
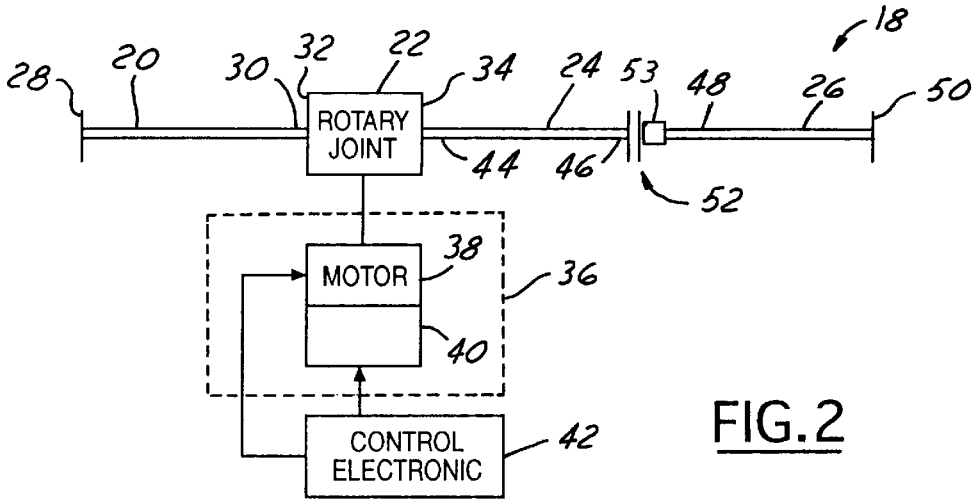
FIG. 2 is a block diagram of a non-blocking, low loss waveguide switch for routing M-inputs to M of N-outputs in accordance with one aspect of the present invention.
Figure 3:
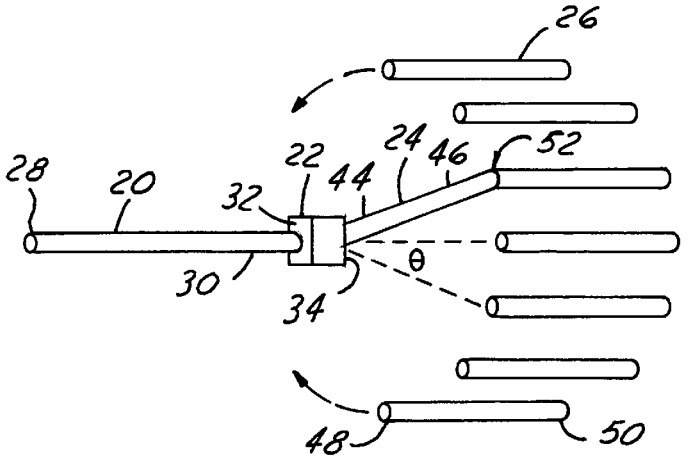
FIG. 3 is a schematic of a waveguide switch in accordance with one aspect of the present invention.

FIG. 2 depicts a block diagram of a non-blocking, low loss waveguide switch 18 for routing M-inputs to M of N-outputs in accordance with one aspect of the present invention, and FIG. 3 is a schematic of a waveguide switch 18 in accordance with one aspect of the present invention. Waveguide switch 18 includes a first transmission line 20, a rotary joint 22, a rotary transmission line 24, and a second transmission line.

First transmission line 20 may be a waveguide, a coaxial line, or a planar transmission line. In the illustrated embodiment, first transmission line 20 is a stationary waveguide. First transmission line 20 includes a first end 28 and a second end 30. First end 28 may be used as either an input or an output. For purposes of this description, first end 28 will be considered an input.

Rotary joint 22 includes a first side 32 and a second side 34. First side 32 is coupled to and rotates around the second end 30 of first transmission line 20. Rotary joint 22 is rotated by joint rotation device 36. Joint rotation device 36 includes a motor 38 and an angle measuring device 40. In the present invention, angle measuring device 40 is an optical encoder. A controller 42 is coupled to motor 38 and optical encoder 40. Controller 42 has control logic operative to control motor 38 to rotate rotary joint 22 to a precise location based on an angle θ detected by optical encoder 40.

Rotary transmission line 24 may be a waveguide, a coaxial line, or a planar transmission line. In the embodiment illustrated, rotary transmission line 24 is a rotary waveguide. Rotary transmission line 24 includes a first rotary end 44 and a second rotary end 46. First rotary end 44 is rigidly coupled to second side 34 of rotary joint 22. Because rotary waveguide 24 is rigidly coupled to rotary joint 22, it may be rotated to align with one of the second transmission lines 26.

Second transmission line 26 may be a waveguide, a coaxial line, or a planar transmission line. In the embodiment shown, second transmission line 26 is a stationary waveguide. Second transmission line 26 includes a third end 48 and a fourth end 50. Fourth end 50 may be used as either an input or an output. For purposes of this description, fourth end 50 will be considered an output. Third end 48 is coupled to second rotary end 46 of rotary waveguide 24 trough a non-contacting waveguide 52. Non-contacting waveguide includes a waveguide gap and a choke flange 53 to minimized radiation loss from the waveguide gap.

The accuracy of angle measuring device 40 determines the maximum number of outputs/inputs available. For example, assuming the number of inputs M equals 1 and that the number of outputs N equals 256, then the spacing between output ports is equal to $2\pi/N=2\pi/256=24.5$ MRAD. If follows that the required accuracy equals the spacing divided by one hundred or 24.5/100=0.245. Current optical encoder capability is $2^{23}$ ports. Therefore, spacing between ports equals $2\pi/2^{23}=0.75$ MRAD and the accuracy equals 0.0075, which is significantly less then 0.245. Hence optical encoder accuracy is easily available. When additional inputs are required, additional waveguide switches must be used. This allows M-inputs to be routed to any M of N-outputs.

The present invention allows the routing of any M-input ports to any M of N output ports without blocking and at low insertion loss. Note that $M \leqq N$ and usually $M \ll N$. In SHF/Ka application, this invention saves approximately 2000 watts of prime power over Butler Matrix Implementation of eight beams, 100 watts per beam. The present invention provides reconfigurable transmission down any 8 beams from 301 beams that cover Earth 16 from geosynchronous orbit without blocking or conflict.

From the foregoing, it can be seen that there has been brought to the art a new and improved non-blocking, low loss waveguide switch for routing M-inputs to M of N-outputs. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A waveguide switch comprising:

a first transmission line having a first end and a second end;

a rotary joint having a first side and a second side, said first side rotationally coupled to said second end of said first transmission line;

a joint rotation device coupled to said rotary joint, whereby said joint rotation device rotates said rotary joint;

a rotary transmission line having a first rotary end and a second rotary end, said first rotary end rigidly coupled to said second side of said rotary joint, whereby said rotary transmission line rotates with said rotary joint;

at least two second transmission lines, each of said second transmission lines having a third end and a forth output end, said third end of one of said second transmission lines coupled to said second rotary end of said rotary transmission line through a non-contacting waveguide, said non-contacting waveguide including a waveguide gap, whereby said second rotary end of said rotary transmission line may rotate between said third ends of each of said second transmission lines; and a controller coupled to said joint rotation device, said controller having control logic operative to control said joint rotation device to rotate said rotary joint to align said rotary transmission line with one of said second transmission lines.

2. The waveguide switch as recited in claim 1, wherein said transmission lines are waveguides.

3. The waveguide switch as recited in claim 1, wherein said transmission lines are coaxial lines.

4. The waveguide switch as recited in claim 1, wherein said transmission lines are planar transmission lines.

5. The waveguide switch as recited in claim 1, wherein said non-contacting waveguide includes a choke joint flange to minimize radiation loss from said waveguide gap.

6. The waveguide switch as recited in claim 1, wherein said non-contacting waveguide includes a choke joint flange to minimize radiation loss from said waveguide gap.

7. The waveguide switch as recited in claim 1, wherein said joint rotation device comprises a motor.

8. The waveguide switch as recited in claim 7, wherein said joint rotation device further comprises an angle measuring device coupled to said motor and said controller, said angle measuring device detecting an angle of said rotary joint.

9. The waveguide switch as recited in claim 8, wherein said angle measuring device comprises an optical encoder.

10. The waveguide switch as recited in claim 1, wherein said first transmission line acts as an input and said two second transmission lines act as outputs.

11. A waveguide switching system, comprising a plurality of waveguide switches formed according to claim 9, whereby M-inputs may be routed to M of N-outputs.

12. The waveguide switch as recited in claim 1, wherein said first transmission line acts as an output and said two second transmission lines act as inputs.

13. A waveguide switching system, comprising a plurality of waveguide switches formed according to claim 12, whereby N-inputs may be routed to N of M-outputs.

14. The waveguide switch as recited in claim 1, wherein said joint rotation device comprises a motor.

15. The waveguide switch as recited in claim 14, wherein said joint rotation device further comprises an optical encoder coupled to said motor and said controller, said optical encoder detecting an angle of said rotary joint.

16. The waveguide switch as recited in claim 1, wherein said first waveguide acts as an input and said two second waveguides act as outputs.

17. A waveguide switching system, comprising a plurality of waveguide switches formed according to claim 16, whereby M-inputs may be routed to M of N-outputs.

18. The waveguide switch as recited in claim 1, wherein said first waveguide acts as an output and said two second waveguides act as inputs.

19. A waveguide switching system, comprising a plurality of waveguide switches formed according to claim 18, whereby N-inputs may be routed to N of M-outputs.

20. A satellite signal routing system, comprising:

a ground station;

a satellite in orbit and in communication with said ground station, said satellite having a waveguide switch comprising:

a first waveguide having a first end and a second end;

a rotary joint having a first side and a second side, said first side rotationally coupled to said second end of said first waveguide;

a joint rotation device coupled to said rotary joint, whereby said joint rotation device rotates said rotary joint;

a rotary waveguide having a first rotary end and a second rotary end, said first rotary end rigidly coupled to said second side of said rotary joint, whereby said rotary waveguide rotates with said rotary joint;

at least two second waveguides, each second of said waveguides having a third end and a forth output end, said third end of one of said second waveguides coupled to said second rotary end of said rotary waveguide through a non-contacting waveguide, said non-contacting waveguide including a waveguide gap, whereby said second rotary end of said rotary waveguide may rotate between said third ends of each of said second waveguides; and a controller coupled to said joint rotation device, said controller having control logic operative to control said joint rotation device to rotate said rotary joint to align said rotary waveguide with one of said second waveguides.

* * * * *